US006638704B2

(12) United States Patent
Kikuchi et al.

(10) Patent No.: US 6,638,704 B2
(45) Date of Patent: Oct. 28, 2003

(54) SILVER HALIDE PHOTOGRAPHIC EMULSION AND LIGHT-SENSITIVE MATERIAL CONTAINING THE SAME

(75) Inventors: Makoto Kikuchi, Kanagawa (JP); Naohiro Takeda, Kanagawa (JP); Yoichi Maruyama, Kanagawa (JP); Yuzo Toda, Tilburg (NL); Masaaki Miki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/186,975

(22) Filed: Jul. 2, 2002

(65) Prior Publication Data

US 2003/0077550 A1 Apr. 24, 2003

Related U.S. Application Data

(62) Division of application No. 09/659,609, filed on Sep. 11, 2000, now abandoned.

(30) Foreign Application Priority Data

Sep. 10, 1999 (JP) ..... P. 11-257426
Sep. 10, 1999 (JP) ..... P. 11-257427
Jul. 18, 2000 (JP) ..... P. 2000-217483

(51) Int. Cl.[7] ..... G03C 1/005; G03C 1/494
(52) U.S. Cl. ..... 430/569; 430/567; 430/631
(58) Field of Search ..... 430/569, 631, 430/567

(56) References Cited

U.S. PATENT DOCUMENTS

| | | | | |
|---|---|---|---|---|
| 5,219,720 | A | | 6/1993 | Black et al. |
| 5,250,403 | A | | 10/1993 | Antoniades et al. |
| 5,334,495 | A | | 8/1994 | Black et al. |
| 5,580,712 | A | | 12/1996 | Keevert et al. |
| 5,587,280 | A | | 12/1996 | Ikeda et al. |
| 5,604,085 | A | * | 2/1997 | Maskasky ..... 430/567 |
| 5,667,955 | A | * | 9/1997 | Maskasky ..... 430/567 |
| 5,744,296 | A | | 4/1998 | Ishikawa et al. |
| 5,906,914 | A | | 5/1999 | Taguchi et al. |
| 6,280,920 | B1 | | 8/2001 | Maruyama et al. |

FOREIGN PATENT DOCUMENTS

EP 0 926 543 A1 6/1999

* cited by examiner

*Primary Examiner*—Geraldine Letscher
(74) *Attorney, Agent, or Firm*—Sughrue Mion, PLLC

(57) ABSTRACT

A silver halide photographic emulsion comprising silver halide grains is disclosed, which is obtained through a process including at least one step of forming grains using a dispersion medium having a low viscosity, wherein 50% or more of the entire projected area of all silver halide grains in the emulsion is occupied by silver halide tabular grains having an aspect ratio of 4 or more and a twin plane spacing of 0.012 $\mu$m or less. Further disclosed is a silver halide color photographic light-sensitive material using the emulsion.

8 Claims, No Drawings

SILVER HALIDE PHOTOGRAPHIC EMULSION AND LIGHT-SENSITIVE MATERIAL CONTAINING THE SAME

This is a divisional of application Ser. No. 09/659,609, filed Sep. 11, 2000, now abandoned, the disclosure of which is incorporated herein by reference.

FIELD OF THE INVENTION

The present invention relates to a silver halide emulsion having low fogging and high sensitivity and also relates to a silver halide color photographic light-sensitive material using the emulsion.

BACKGROUND OF THE INVENTION

In recent years, the requirements for silver halide photographic emulsions are becoming severer. To speak more specifically, the emulsion is demanded to have higher sensitivity, improved relationship of the sensitivity/fog ratio and higher image quality. One of the techniques for elevating the sensitivity of a silver halide emulsion and thereby attaining a higher image quality is to use tabular grains. The tabular grain has advantage in that higher sensitivity can be achieved including the improvement in the color sensitization efficiency due to the sensitizing dye, the relationship of the sensitivity/granularity ratio can be improved, the sharpness can be elevated owing to the optical properties peculiar to the tabular grain, and the covering power can be increased.

However, the silver halide tabular grain capable of successfully ensuring higher sensitivity and improved relationship of the sensitivity/granularity ratio suffers from increased fogging. Thus, the problem to be solved is to attain low fogging at the same time.

With respect to the technique for improving the relationship of the sensitivity/granularity ratio of tabular grains, for example, U.S. Pat. Nos. 5,219,720 and 5,334,495 disclose a technique of using tabular grains having a small spacing between twin planes. Even by this technique, however, it has been found to be impossible to satisfy two requirements at the same time that the tabular grain has a high aspect ratio and a small twin plane spacing and that the grain shape/structure (twin plane spacing distribution, tabular grain ratio and equivalent-circle corresponding diameter distribution (i.e., equivalent-circle diameter distribution)) is highly uniform among grains. Thus, the above-described technique is not enough to obtain a silver halide emulsion having both low fogging and high sensitivity.

With respect to the technique for controlling the shape of silver halide grains and thereby forming uniform silver halide grains, for example, U.S. Pat. Nos. 5,580,712 and 5,670,616 disclose a technique of using a biopolymer at the grain formation. However, these patents neither teach nor suggest the technique of the present invention where a dispersion medium having a low viscosity is used at the grain formation, so that the grains formed can have a high aspect ratio and a small twin plane spacing and among the grains, the twin plane spacing distribution, the tabular grain ratio and the equivalent-circle diameter distribution can be uniform.

Conventional gelatin heretofore used in silver halide emulsions is described in detail below. In the process of forming silver halide emulsion grains, gelatin is used in several steps. The function required for the gelatin differs among respective steps and the gelatin is preferably designed in the molecular level to satisfy the use purpose in each step.

During the process of forming silver halide emulsion grains, at least one gelatin is used as a protective colloid of a silver halide grain in the nucleation step and subsequent ripening/growing step. Recently, for preparing a silver halide tabular grain emulsion having a high aspect ratio, a chemically modified gelatin is being aggressively used. JP-B-5-12696 (the term "JP-B" as used herein means an "examined Japanese patent publication") discloses a technique of using a gelatin of which sulfide group is rendered ineffective by hydrogen peroxide or the like, as the protective colloid and thereby preparing tabular grains having a small thickness. Also, JP-A-8-82883 (the term "JP-A" as used herein means an "unexamined published Japanese patent application") discloses a technique of making the amino group and the sulfide group ineffective and thereby preparing tabular grains having a small thickness. In addition, JP-A-10-148897 discloses a technique of introducing two or more carboxyl groups at the time of chemically modifying the amino group in gelatin and thereby preparing monodisperse tabular grains having a small thickness. Furthermore, U.S. Pat. No. 5,580,712 and EP-A-926544 disclose a technique for increasing the formation ratio of tabular grains, where gelatin for use as a protective colloid is designed in the molecular level and a gelatin derivative prepared using a technique of chemical synthesis or genetic engineering is used.

However, there is not known a technique such that gelatin for use as a protective colloid is subjected to chemical modification or molecular designing during the grain formation process of a silver halide grain emulsion with the intention of changing the property, thereby optimizing the macroscopically physical properties of the dispersion medium, such as viscosity, and in turn obtaining objective silver halide grains. For example, on taking account of the dependency of the solubility of silver halide on the temperature, it would be easily anticipated that if gelatin incapable of gelling under a lower temperature can be used, the silver halide grains may be more finely formed.

At present, the industrially produced gelatin is generally derived from collagen contained in animal bone or skin. One of the defects of the animal collagen-derived gelatin is the polydisperse molecular weight. This polydisperse molecular weight is apparently disadvantageous for controlling the physical properties of a dispersion medium containing the gelatin. If a gelatin having a monodisperse molecular weight is found, the grain shape may also be rendered monodisperse in the process of forming silver halide grains.

According to the technique of producing a gelatin derivative using a technique of chemical synthesis or genetic engineering described in U.S. Pat. No. 5,580,712 and EP-A-926543, the gelatin derivative theoretically has a monodisperse molecular weight (also experimentally, when the molecular weight distribution is measured using a gel permeation chromatography, the molecular weight is found to be substantially monodisperse). However, this gelatin having a monodisperse molecular weight is not intended to use so as to optimize the physical properties of the dispersion medium used in the production process of a silver halide grain emulsion.

With respect to the technique for forming silver halide fine grains, for example, JP-A-10-43570, JP-A-4-292416, U.S. Pat. No. 5,250,403, JP-W-6-507255 (the term "JP-W" as used herein means an "unexamined published international patent application"), JP-A-4-139440 and JP-A-9-179225 disclose it. These patents also disclose a technique of using silver halide grains in the growth step and thereby forming silver halide tabular grains.

It is known that when silver halide tabular grains are formed by using silver halide fine grains in the growth step, tabular grains having a very small thickness are obtained and the grains are uniform in the halogen composition.

In the case of using silver halide fine grains in the growth step, the fine grains added are dissolved and consumed for the growth of previously existing tabular grains. However, if the fine grain has a large sphere-corresponding diameter (i.e., a large equivalent-sphere diameter), these coarse grains are not dissolved and remain even after the growth step. If the fine grain added has a twin plane, the grain itself grows and turns to a silver halide tabular grain, as a result, the grain size or grain size distribution of finally obtained grains cannot be controlled.

In order not to allow the fine grains to remain, a method where a silver salt aqueous solution and a halide salt aqueous solution each in a low concentration are mixed in an external mixer to form silver halide fine grains and the grains are immediately used in the growth step, may be used. By reducing the concentrations of the solutions added, the grain size of silver halide fine grains can be made small. This method has, however, a problem in the productivity.

In another method for not allowing fine grains to remain, a part of the internal solution used for the growth is re-circulated into the external mixer. This method has, however, disadvantage in that the apparatus is complicated.

Under these circumstances, one of the important problems to be solved in the field of forming photographic silver halide grains is to form monodisperse silver halide grains having a small grain size while preventing the apparatus from being complicated and while ensuring sufficiently high productivity.

SUMMARY OF THE INVENTION

One object of the present invention is to provide a silver halide emulsion having low fog and high sensitivity.

Another object of the present invention is to provide a silver halide color photographic light-sensitive material using the emulsion.

As a result of extensive investigations, the present inventors have found that when a dispersion medium having a low viscosity is used in the grain formation process, tabular grains having a high aspect ratio and a small twin plane spacing, in which the twin plane spacing distribution, the tabular grain ratio and the equivalent-circle diameter distribution are uniform among grains, can be obtained and the capability of the silver halide emulsion can be remarkably improved (reduction in fogging and elevation of sensitivity).

The above-described objects of the present invention can be effectively attained by the following embodiments.

(1) A silver photographic emulsion comprising silver halide grains, which is obtained through a process including at least one step of forming grains using a dispersion medium having a low viscosity, wherein 50% or more of the entire projected area of all silver halide grains in the emulsion is occupied by silver halide tabular grains having an aspect ratio of 4 or more and a twin plane spacing of 0.012 μm or less.

(2) The silver halide photographic emulsion as described in (1) above, which is obtained through a process including at least one step of forming grains using a dispersion medium having a low viscosity at a low temperature.

(3) The silver halide photographic emulsion as described in (1) or (2) above, wherein the protective colloid in the dispersion medium having a low viscosity is gelatin.

(4) The silver halide photographic emulsion as described in any one of (1) to (3) above, wherein the protective colloid in the dispersion medium has a monodisperse molecular weight distribution.

(5) The silver halide photographic emulsion as described in any one of (1) to (4) above, wherein the protective colloid in the dispersion medium is produced using a technique of chemical synthesis or genetic engineering.

(6) The silver halide photographic emulsion as described in (1) above, wherein 50% or more of the entire projected area of all silver halide grains in the emulsion is occupied by silver halide tabular grains having an aspect ratio of 4 or more and a twin plane spacing of 0.010 μm or less.

(7) The silver halide photographic emulsion as described in (1) above, wherein 50% or more of the entire projected area of all silver halide grains in the emulsion is occupied by silver halide tabular grains having an aspect ratio of 8 or more and a twin plane spacing of 0.012 μm or less.

(8) The silver halide photographic emulsion as described in (1) above, wherein 50% or more of the entire projected area of all silver halide grains in the emulsion is occupied by silver halide tabular grains having an aspect ratio of 8 or more and a twin plane spacing of 0.010 μm or less.

(9) The silver halide photographic emulsion as described in any one of (1) to (8) above, wherein the coefficient of variation in the twin plane spacing distribution of all silver halide grains in the emulsion is from 3 to 25%.

(10) The silver halide photographic emulsion as described in any one of (1) to (8) above, wherein the coefficient of variation in the twin plane spacing distribution of all silver halide grains in the emulsion is from 3 to 15%.

(11) The silver halide photographic emulsion as described in any one of (1) to (10) above, wherein from 95 to 100% of the entire projected area of all silver halide grains in the emulsion is occupied by tabular grains having an aspect ratio of 4 or more and a twin plane spacing of 0.012 μm or less.

(12) The silver halide photographic emulsion as described in any one of (1) to (11) above, wherein the coefficient of variation in the equivalent-circle diameter distribution of all silver halide grains in the emulsion is from 3 to 20%.

(13) The silver halide photographic emulsion as described in (1) to (12) above, which is obtained through a process including at least one step of forming grains using a dispersion medium having a low viscosity and which is prepared using a silver halide fine grain emulsion satisfying all the following requirements (i) to (iv):

(i) the silver bromide content is 50 mol % or more;

(ii) the average equivalent-sphere diameter is 0.02 μm or less;

(iii) the coefficient of variation of the equivalent-sphere diameter is 30% or less; and (iv) the ratio by number of grains containing a twin plane is 3% or less.

(14) A silver halide color photographic light-sensitive material comprising a support having thereon at least one silver halide emulsion layer, wherein at least one of the silver halide emulsion layers contains the silver halide photographic emulsion described in any one of (1) to (13) above.

DETAILED DESCRIPTION OF THE INVENTION

The silver halide emulsion of the present invention is described below. In one preferred embodiment of the emulsion, the emulsion is obtained through a process including at least one step of forming grains using a dispersion medium having a low viscosity, wherein 50% or more of the entire projected area of all silver halide grains in the emulsion is occupied by silver halide tabular grains having an aspect ratio of 4 or more and a twin plane spacing of 0.012 μm or less, preferably the coefficient of variation in the twin plane spacing distribution of all silver halide grains in the emulsion is from 3 to 25%, preferably from 95 to 100% of the entire projected are of all silver halide grains in the emulsion is occupied by tabular grains, and preferably the coefficient of variation in the equivalent-circle diameter distribution of all silver halide grains in the emulsion is from 3 to 20%.

The shape of the silver halide emulsion of the present invention is described below.

The emulsion of the present invention is mainly occupied by silver iodobromide or silver iodochlorobromide tabular grains having a (111) face as a main plane. The term "silver halide tabular grain" as used herein means a generic term of silver halide grains having one twin plane or two or more parallel twin planes. The twin plane means a (111) face when ions in all lattice points on both sides of the (111) face are in the mirror image relationship. The tabular grain is, when viewed from the direction perpendicular to the main plane, in the triangular, tetragonal or hexagonal form or in the circular form as a rounded triangle, tetragon or hexagon. The triangular, hexagonal or circular grain has triangular, hexagonal or circular main planes, respectively, which are parallel with each other.

In the emulsion of the present invention, the projected areas of tabular grains preferably occupy the entire projected area of (silver halide) grains in the emulsion (i.e., emulsion grains) as large as possible and preferably occupy from 95 to 100%, more preferably from 98 to 100%. Mixing of grains (e.g., regular crystal, non-parallel multiple twin) other than the tabular grain is not preferred in view of the uniformity among grains.

The projected area of a grain can be obtained by measuring the area on a photograph taken through an electron microscope and correcting the magnification at the photographing.

In the emulsion of the present invention, hexagonal tabular grains having an adjacent side ratio (longest side/shortest side) of 1 to 1.5 preferably occupy from 70 to 100%, more preferably from 80 to 100%, still more preferably from 90 to 100%, of the entire projected area of all grains. In a preferred embodiment of the emulsion of the present invention, hexagonal tabular grains having an adjacent side ratio (longest side/shortest side) of 1 to 1.2 preferably occupy from 50 to 100%, more preferably from 70 to 100%, still more preferably from 80 to 100%, of the entire projected area of all grains. Mixing of tabular grains other than this hexagonal tabular grain is not preferred in view of the uniformity among grains.

In the present invention, the average equivalent-circle diameter of tabular grains is preferably from 0.3 to 6.0 μm, more preferably from 0.5 to 5.0 μm, still more preferably from 1.0 to 4.0 μm. With an average diameter out of this range, the effect of the present invention may not be obtained.

The term "equivalent-circle diameter" as used in the present invention means a diameter of a circle having an area equal to the projected area of parallel outer surfaces of a grain. The "average equivalent-circle diameter" is an arithmetic mean of equivalent-circle diameters of all tabular grains in the emulsion.

In the present invention, the average grain thickness of tabular grains is preferably from 0.03 to 0.35 μm, more preferably from 0.05 to 0.25 μm, still more preferably from 0.05 to 0.20 μm. The average grain thickness is an arithmetic mean of grain thicknesses of all tabular grains in the emulsion. If the average grain thickness is less than 0.03 μm, the emulsion is difficult to prepare, whereas if it exceeds 0.35 μm, the advantageous properties of the tabular grain may not be successfully brought out.

The thickness of a grain can be easily determined by depositing a metal together with a latex for control on a grain from the oblique direction, measuring the length of the shadow thereof on a photograph taken through an electron microscope and calculating the thickness by referring to the length of the shadow of the latex.

In the present invention, the average twin plane spacing of tabular grains is 0.012 μm or less, preferably 0.010 μm or less (also, preferably 0.0001 μm or more). The "average twin plane spacing" is an arithmetic mean of twin plane spacings of all tabular grains in the emulsion.

The "twin plane spacing" means a distance between two twin planes in the case of a grain having two twin planes within the grain and means the longest distance among the distances between twin planes in the case of a grain having three or more twin planes. The twin plane can be observed by a transmission-type electron microscope.

More specifically, a sample where tabular grains are oriented almost in parallel to the support is prepared and the sample is cut by a diamond knife to prepare a slice having a thickness of about 0.1 μm. By observing this slice through a transmission electron microscope, the twin plane of a tabular grain can be detected. When an electron beam passes through the twin plane, the electron wave undergoes shifting of the phase and thereby the presence of the twin plane can be acknowledged.

The ratio of the equivalent-circle diameter to the thickness of a silver halide grain is called an aspect ratio. In other words, the aspect ratio is a value obtained by dividing the diameter of a corresponding circle having the projected area of each silver halide grain by the grain thickness. The aspect ratio may be measured, for example, by a method where a photograph of the emulsion is taken through a transmission electron microscope by the replica process and the diameter of a circle having an area equal to the projected area of individual grains (equivalent-circle diameter) and the thickness thereof are determined. In this case, the thickness is calculated from the length of the shadow of the replica.

In the present invention, the aspect ratio of the tabular grain is 4 or more, but the aspect ratio for all tabular grains in the emulsion is preferably from 4 to 60, more preferably from 6 to 50, still more preferably from 8 to 40. The "average aspect ratio for all tabular grains" is an arithmetic mean of aspect ratios of all tabular grains in the emulsion.

In the emulsion of the present invention, silver halide tabular grains having an aspect ratio of 4 or more and a twin plane spacing of 0.012 μm or less occupy 50% or more of the entire projected areas of grains in the emulsion (i.e., emulsion grains). More preferably, silver halide tabular grains having an aspect ratio of 4 or more and a twin plane spacing of 0.010 μm or less occupy 50% or more of the entire projected area of grains in the emulsion.

In another preferred embodiment of the emulsion of the present invention, silver halide tabular grains having an aspect ratio of 8 or more and a twin plane spacing of 0.012 μm or less occupy 50% or more of the entire projected area of emulsion grains. More preferably, silver halide tabular grains having an aspect ratio of 8 or more and a twin plane spacing of 0.010 μm or less occupy 50% or more of the entire projected area of emulsion grains.

The emulsion of the present invention preferably comprises monodisperse grains. In the present invention, the coefficient of variation in the grain size (equivalent-sphere diameter (i.e., equivalent-sphere diameter) distribution of all silver halide grains is preferably from 3 to 30%, more preferably from 3 to 25%, still more preferably from 3 to 20%. The "coefficient of variation in the equivalent-sphere diameter distribution" means a value obtained by dividing the dispersion (standard deviation) of the equivalent-sphere diameters of individual grains by the average equivalent-sphere diameter.

If the coefficient of variation in the equivalent-sphere diameter of all tabular grains in the emulsion exceeds 30%, disadvantageous results may occur in view of the uniformity among grains, whereas if it is less than 3%, the emulsion is difficult to prepare.

In the present invention, it is preferred that the coefficient of variation in the equivalent-circle diameter distribution of all silver halide grains in the emulsion is low, in view of the uniformity among grains. That is, the coefficient of variation is preferably 3 to 20%, more preferably 3 to 15%. The "coefficient of variation in the equivalent-circle diameter distribution" means a value obtained by dividing the dispersion (standard deviation) of the equivalent-circle diameter of individual grains by the average equivalent-circle diameter.

In the present invention, the coefficient of variation in the grain thickness distribution of all tabular grains in the emulsion is preferably from 3 to 25%, more preferably from 3 to 20%, still more preferably from 3 to 15%. The coefficient of variation in the grain thickness distribution means a value obtained by dividing the dispersion (standard deviation) of the grain thicknesses of individual tabular grains by the average grain thickness. If the coefficient of variation in the grain thickness distribution of all tabular grains exceeds 25%, disadvantageous results may occur in view of the uniformity among grains, whereas if it is less than 3%, the emulsion is difficult to prepare.

In the present invention, the coefficient of variation in the twin plane spacing distribution of all silver halide grains in the emulsion is preferably as low as possible in view of the uniformity among grains and it is preferably from 3 to 25%, more preferably from 3 to 15%. The coefficient of variation in the twin plane spacing distribution means a value obtained by dividing the dispersion (standard deviation) of twin plane spacings of individual grains by the average twin plane spacing.

In the present invention, the grain thickness, the twin plane spacing, the aspect ratio and the monodispersity may be selected within the above-described ranges according to the purpose, however, use of monodisperse tabular grains having a small grain thickness, a small twin plane spacing and a high aspect ratio is preferred.

In the present invention, various methods may be used for forming a tabular grain having a high aspect ratio. For example, the grain formation methods described in U.S. Pat. Nos. 5,496,694 and 5,498,516 may be used. Furthermore, for forming a tabular grain having an ultrahigh aspect ratio, the grain formation methods described in U.S. Pat. Nos. 5,494,789 and 5,503,970 may be used.

For forming monodisperse tabular grains having a high aspect ratio, it is important to produce small-size twin nuclei within a short period of time. To realize this, the nucleation is preferably performed under the conditions of low temperature, high pBr, low pH and low gelatin amount within a short period of time. With respect to the kind of the gelatin, those having a low molecular weight or having a small methionine content or those in which the amino group is modified by a phthalic acid, a trimellitic acid or a pyromellitic acid are preferred.

After the nucleation, the emulsion is physically ripened so as to allow the nuclei of regular crystal, single twin or non-parallel multiple twin to disappear and selectively allow the nuclei of parallel double twin to remain. The remaining parallel double twin nuclei are preferably further ripened so as to elevate the monodispersity.

The physical ripening is also preferably performed in the presence of PAO (polyalkylene oxide) described, for example, in U.S. Pat. No. 5,147,771 so as to increase the monodispersity.

After the physical ripening, gelatin is further added and then a soluble silver salt and a soluble halogen salt are added to grow the grains. The gelatin further added here is also preferably a gelatin in which the amino group is modified by a phthalic acid, a trimellitic acid or a pyromellitic acid.

The silver and the halide used for the growth of grains may also be preferably supplied by adding silver halide fine grains which are separately prepared in advance or simultaneously prepared in a different reactor.

At the grain growth, it is also important to control and optimize the reaction solution temperature, the pH, the binder amount, the pBr and the feeding rates of silver and halide ion.

In the present invention, a dispersion medium having a low viscosity is used in at least one step during the above-described grain formation process (nucleation, ripening and growth) of the emulsion. The dispersion medium having a low viscosity is described below.

The viscosity of the dispersion medium is greatly influenced by the kind of the protective colloid in the dispersion medium, the concentration thereof, the temperature of the system, the ionic strength and the pH. Depending on the kind of the protective colloid, the viscosity of the dispersion medium may vary with the passing of time.

The viscosity of the dispersion medium is measured using a rotary viscometer. In the present invention, the viscosity of the dispersion medium is measured after the protective colloid is dissolved and left standing for 1 hour.

The term "low viscosity" as used in the present invention means the region lower than the viscosity η of the dispersion medium obtained by the following formula (1):

$$\eta=(2.8159-0.0743T)\exp\{(0.1479-0.0017T)C\} \quad (1)$$

wherein η is a viscosity (cp) of the dispersion medium, T is the temperature (° C.) of the dispersion medium and C is the concentration (wt %) of the protective colloid in the dispersion medium.

The ionic strength of the dispersion medium is preferably 2 or less, more preferably 1.5 or less, still more preferably 1 or less. The pH of the dispersion medium is preferably from 2 to 11, more preferably from 3 to 10, still more preferably from 4 to 9.

In the present invention, the low temperature is preferably 30° C. or less, more preferably 20° C. or less, still more preferably 10° C. or less.

The protective colloid in the dispersion medium for use in the present invention may be gelatin. The molecular weight of gelatin is at least 2,500, preferably 10,000 or more.

Examples of the gelatin which can be used include alkali-treated gelatin derived from animal collagen, oxidation-treated gelatin resulting from an oxidation treatment of the methionine group in the gelatin molecule with hydrogen peroxide or the like (methionine content: 40 μmol/g or less), amino group-modified gelatin (e.g., phthalated gelatin, trimellited gelatin, succinated gelatin, maleated gelatin, esterified gelatin), and low molecular weight gelatin (molecular weight: from 2,500 to 40,000).

For obtaining the low-viscosity dispersion medium of the present invention, it is effective that the protective colloid has a monodisperse molecular weight distribution. The term "monodisperse" as used herein means that the molecular weight distribution curve determined by the gel permeation chromatography according to the PAGI method has a substantially symmetric single peak. The distribution width of the molecular weight is preferably ±150% or less, more preferably ±100% or less, still more preferably ±80% or less, with respect to the average molecular weight as the center.

The protective colloid for use in the present invention may be preferably produced using a technique of chemical synthesis or genetic engineering. According to the technique of chemical synthesis, a compound which works out to a protective colloid, such as polypeptide, is synthesized by a chemical reaction one by one to have a desired amino acid sequence. At present, even a synthesis apparatus capable of allowing the chemical reaction to automatically proceed is available on the market.

The technique of genetic engineering is described below. A part of ribonucleic acid (RNA) in cells of a certain organism (for example, *E. Coli* or yeast plant) is cut out and a desired amino acid sequence is assembled thereinto instead. This ribonucleic acid is further assembled into deoxyribonucleic acid (DNA). After the assembly, the organism recognizes it as a compound necessary for his organism and starts producing the compound having the desired amino acid sequence. It may also be possible to directly take out the DNA itself of an organism and assemble a desired amino acid residue thereinto. The technique of obtaining a compound which works out to a protective colloid by these methods is called a technique of genetic engineering.

The protective colloid obtained by this technique is characterized by having a fixed molecular weight. A representative example of the protective colloid is gelatin which is mass-produced in industry, however, since animal bone or skin is used as a starting material, the gelatin is disadvantageous in that impurities are present and the reproducibility is poor due to the lack of clear definition of the composition. These defects can be overcome if the above-described technique of chemical synthesis or genetic engineering is used.

The gelatin for use in the emulsion of the present invention is derived from animal collagen and can have an amino acid equal to the naturally occurring product. The term "equal" as used herein means that the identity of the amino acid to the naturally occurring product is at least 80%, preferably 90%.

The emulsion of the present invention can contain gelatin derived from animal collagen having substantially the same amino acid sequence as one in the naturally occurring product. The term "substantially" as used herein means that the amino acid variation is less than 5 variants, preferably less than 3 variants. The suitable kind of collagen is I or III. In order to ensure the activity and prevent the expression problem, the sequence is preferably close to the natural sequence. The DNA which codes for the amino acid sequence of the gelatin may be a naturally occurring product or a synthetic product. The collagen type III amino acid sequence for use in the present invention is suitably the sequence shown in FIG. 3 of EP-A-0926543 or has the sequence. The collagen type I amino acid sequence for use in the present invention is the sequence shown in FIG. 8, 10 or 12 of EP-A-0926543 or has the sequence. The collagen type III has an amino acid prescribed in *Biochim. Biophys.* 1271:1–48, Acta (1994). This publication is inserted into the present specification by way of reference.

With respect to the production method of gelatin using the chemical synthesis or genetic engineering technique, U.S. Pat. No. 5,807,12 may also be referred to.

The composition of the emulsion of the present invention is described below.

In order to form silver halide grains for use in the present invention, silver iodobromide or silver chloroiodobromide is preferably used. In the case where the grain has a phase containing iodide or chloride, the phase may be uniformly dispersed within the grain or may be localized.

Also, another silver salt such as silver rhodanate, silver sulfide, silver selenide, silver carbonate, silver phosphate or organic acid silver may be contained as a foreign grain or a part of the silver halide grains.

The silver halide grain in the emulsion (i.e., the silver halide emulsion grain) of the present invention preferably has a silver bromide content of 80 mol % or more, more preferably 90 mol % or more.

Furthermore, the silver halide grain in the emulsion of the present invention preferably has a silver iodide content of 1 to 20 mol %, more preferably from 2 to 15 mol %, still more preferably from 3 to 10 mol %. If the silver iodide content is less than 1 mol %, the effect of intensifying the dye adsorption or increasing the intrinsic sensitivity is disadvantageously difficult to bring out, whereas if it exceeds 20 mol %, the development rate generally decreases and this is not preferred.

The silver halide grain in the emulsion of the present invention preferably has a coefficient of variation in the silver iodide content distribution among grains, of less than 30%, more preferably from 3 to 25%, still more preferably from 3 to 20%. If the coefficient of variation in the silver iodide content distribution among grains is less than 3%, the emulsion is difficult to obtain, whereas if it exceeds 30%, disadvantageous results may arise in the uniformity among grains.

The silver iodide content of each grain in the emulsion may be determined by analyzing the composition of individual grains using X-ray Microanalyzer.

This measuring method is described, for example, in European Patent 147,868.

The emulsion of the present invention preferably has a surface iodide content of 5 mol % or less, more preferably 4 mol % or less, still more preferably 3 mol % or less. If the surface iodide content exceeds 5 mol %, the development or chemical sensitization may be disadvantageously inhibited. The surface iodide content can be determined by an ESCA (also called XPS) method (a method of irradiating an X ray and spectroanalyzing the photoelectrons coming out from the grain surface).

The grain in the emulsion of the present invention mainly comprises (111) face and (100) face. The ratio of the (111) face occupying in the entire surface of the silver halide grains in the emulsion of the present invention is preferably at least 70%.

In the grain in the emulsion of the present invention, the (100) face appears on the lateral surface of a tabular grain.

The ratio of the area occupied by the (100) face to the grain in the emulsion surface to the area occupied by the (111) face on the emulsion grain surface is at least 2%, preferably 3% or more, more preferably 4% or more. The ratio of the (100) face may be controlled by referring to JP-A-2-298935 or JP-A-8-334850. The ratio of the (100) face can be determined by a method utilizing the difference in the adsorption dependency between the (111) face and the (100) face at the adsorption of a sensitizing dye, for example, the method described in T. Tani, *J. Imaging Sci.,* 29, 165 (1985).

In the present invention, 50% or more of the entire projected area of the emulsion grains is preferably occupied by a tabular grain where the area ratio of the (100) face on the lateral surface of the grain is 15% or more, more preferably occupied by a tabular grain where the area ratio of the (100) face is 25% or more. The area ratio of the (100) face on the lateral surface of a tabular grain can be determined by a method described, for example, in JP-A-8-334850.

In the present invention, the tabular grain has a dislocation line inside the grain. The introduction of a dislocation line into the inside of a tabular grain is described below.

The dislocation line is a linear lattice defect generated at the boundary between the already slipped region and the non-slipped region on the slip plane of a crystal. The dislocation line of a silver halide crystal can be analyzed by the X-ray diffraction method or the direct observation method using a low-temperature transmission-type electron microscope and these are described in 1) C. R. Berry, *J. Appl. Phys.,* 27, 636 (1956), 2) C. R. Berry and D. C. Skilman, *J. Appl. Phys.,* 35, 2165 (1964), 3) J. F. Hamilton, *Phot. Sci. Eng.,* 11, 57 (1967), 4) T. Shiozawa, *J. Soc. Phot. Sci. Jap.,* 34, 16 (1971), 5) T. Shiozawa, *J. Soc. Phot. Sci. Jap.,* 35, 213 (1972), and the like. In the case of directly observing the dislocation line using a transmission-type electron microscope, a silver halide grain is taken out from an emulsion by taking care not to impose a pressure highly enough to generate any dislocation line on the grain, the silver halide grain is placed on a mesh for the observation through an electron microscope, and the sample is observed according to the transmission method while keeping the sample in the cooled state so as to prevent damages (for example, print-out) by the electron beam.

In this case, as the thickness of the grain is larger, the electron beam is more difficult to transmit, therefore, a high-pressure type (200 kV or more for the thickness of 0.25 μm) electron microscope is preferably used for attaining clearer observation.

With respect to the effect of the dislocation line on the photographic performance, G. C. Farnell, R. B. Flint and J. B. Chanter, *J. Phot. Sci.,* 13, 25 (1965) describes the fact that in a large-size silver halide tabular grain having a high aspect ratio, the site where a latent image nucleus is formed has a close relationship with the defect within the grain. For example, U.S. Pat. Nos. 4,806,461, 5,498,516, 5,496,694, 5,476,760 and 5,567,580, JP-A-4-149541 and JP-A-4-149737 describes a technique for introducing under control of a dislocation line into a silver halide grain. In these patents, a tabular grain having introduced thereinto a dislocation line is verified to be superior in the photographic properties such as sensitivity and pressure property, as compared with a tabular grain free of a dislocation line. The emulsions described in these patents may also be preferably used in the present invention.

In the present invention, a dislocation line is preferably introduced into the inside of a tabular grain by epitaxially growing a silver halide phase containing silver iodide to a base tabular grain (also called a host grain) and then forming a silver halide shell.

The silver iodide content of the host grain is preferably from 0 to 15 mol %, more preferably from 0 to 12 mol %, still more preferably from 0 to 10 mol %, however, the silver iodide content may be selected according to the purpose. If the silver iodide content of the host grain exceeds 15 mol %, the development rate generally decreases and this is not preferred.

The composition of the silver halide phase epitaxially grown on the host grain preferably has a higher silver iodide content. The silver halide phase which is epitaxially grown may be any of silver iodide, silver iodobromide, silver chloroiodobromide and silver chloroiodide. Among these, silver iodide and silver iodobromide are preferred and silver iodide is more preferred. In the case of silver iodobromide, the silver iodide (iodide ion) content is preferably from 1 to 45 mol %, more preferably from 5 to 45 mol %, still more preferably from 10 to 45 mol %. The silver iodide content is preferably as high as possible for forming a misfit necessary for the introduction of a dislocation line, however, the solid solubility limit of silver iodobromide is 45 mol %.

The amount of a halogen added for forming the high silver iodide content phase which is epitaxially grown on the host grain is preferably from 2 to 15 mol %, more preferably from 2 to 10 mol %, still more preferably from 2 to 5 mol %, based on the silver amount of the host grain. If the amount of a halogen added is less than 2 mol %, the introduction of a dislocation line becomes difficult and this is not preferred, whereas if it exceeds 15 mol %, the development rate disadvantageously decreases.

At this time, the high silver iodide content phase after the grain formation preferably accounts for 5 to 60 mol %, more preferably 10 to 50 mol %, most preferably from 20 to 40 mol %, of the total silver amount of the grain. If this is less than 5 mol % or exceeds 60 mol %, the effect of elevating the sensitivity by the introduction of a dislocation line may not be successfully brought out.

In the formation of the high silver iodide content phase on a host grain, the forming site can be freely selected. The high silver iodide content phase may be formed to cover the host grain or may be formed only at a specific portion. However, the site of a dislocation line within the grain is preferably controlled by epitaxially growing the high silver iodide content phase at a specific portion selected.

In the present invention, the high silver iodide content phase is particularly preferably formed at the edge part and/or the apex part of the host tabular grain. At this time, the composition of the halide added, the adding method, the temperature of the reaction solution, the pAg, the concentration of the solvent, the concentration of gelatin, the ionic strength and the like may be freely selected. The silver iodide content phase within a grain can be measured by an analytical electron microscope described, for example, in JP-A-7-219102.

In the present invention, for forming the high silver iodide content phase on a host grain, a method of adding a water-soluble iodide solution such as potassium iodide solely or simultaneously with a water-soluble silver salt solution such as silver nitrate, a method of adding fine grains of a silver halide containing silver iodide, or a method of releasing iodide ion from an iodide ion-releasing agent upon reaction with an alkali or a nucleophilic agent described, for example, in U.S. Pat. Nos. 5,498,516 and 5,527,664 may be preferably used.

After epitaxially growing the high silver iodide content phase on a host grain, a silver halide shell is formed on the outer side of the host tabular grain and thereby a dislocation line is introduced. The composition of the silver halide shell may be any of silver bromide, silver iodobromide and silver chloroiodobromide. Among these, silver bromide and silver iodobromide are preferred.

In the case of silver iodobromide, the silver iodide content is preferably from 0.1 to 12 mol %, more preferably from 0.1 to 10 mol %, and most preferably from 0.1 to 3 mol %.

If the silver iodide content is less than 0.1 mol %, the effect of intensifying the dye adsorption or accelerating the development may not be successfully obtained and this is not preferred, whereas if it exceeds 12 mol %, the development rate disadvantageously decreases.

The amount of silver used for the growth of the silver halide shell is preferably from 10 to 50 mol %, more preferably from 20 to 40 mol %, based on the total silver amount of the grain.

In the above-described process of introducing a dislocation line, the temperature is preferably from 30 to 80° C., more preferably from 35 to 75° C., still more preferably from 35 to 60° C. For controlling the temperature to a low temperature of less than 30° C. or to a high temperature in excess of 80° C., a production apparatus having high capacity is necessary and this is disadvantageous in view of the production. In the above-described process of introducing a dislocation line, the pAg is preferably from 6.4 to 10.5.

In the case of a tabular grain, the site and the number of dislocation lines can be determined for each grain by taking a photograph of grains using an electron microscope as described above and viewing it from the direction perpendicular to the main plane. In the introduction of a dislocation line into a tabular grain of the present invention, the site is preferably limited to the fringe part of the grain as much as possible. The term "fringe part" as used in the present invention means the outer circumference of a tabular grain, more specifically, the outer side of a point where in the silver iodide distribution from a side to the center of a tabular grain, the silver iodide content viewed from the "side" first exceeds or falls below the average silver iodide content of the grain as a whole.

In the present invention, it is preferred to introduce dislocation lines in a high density into the fringe part of a tabular grain. The tabular grain preferably has 10 or more, more preferably 30 or more, still more preferably 50 or more, dislocation lines in the fringe part of the grain. In the case where the dislocation lines observed are densely present or intersected with each other, the number of dislocation lines per one grain may not be exactly counted in some cases. However, even in these cases, an approximate number may be counted like about 10, 20 or 30 lines.

The tabular grains of the present invention are preferably uniform in the dislocation line distribution among grains. In the emulsion of the present invention, silver halide tabular grains containing 10 or more dislocation lines at the grain fringe part per one grain preferably occupy 50% or more, more preferably 80% or more, of the entire projected area. If this is less than 50%, the effect of elevating the sensitivity may not be successfully attained.

Furthermore, in the present invention, silver halide tabular grains containing 30 or more dislocation lines per one grain preferably occupy 50% or more, more preferably 80% or more, of the entire projected area.

The tabular grains of the present invention are preferably uniform in the site of dislocation lines introduced into the inside of a grain. In the emulsion of the present invention, silver halide tabular grains in which dislocation lines are localized substantially only in the grain fringe part preferably occupy 50% or more, more preferably 60% or more, still more preferably 80% or more, of the entire projected area.

Furthermore, the fringe region in which dislocation lines are localized is preferably present over a large part of the outer circumference when the tabular grain is viewed from the direction perpendicular to the main plane. For example, in the case of an emulsion mainly comprising hexagonal tabular grains, grains in which dislocation lines are localized in all of the 6 sides are preferably present as many as possible.

The term "substantially only in the grain fringe part" as used herein means that the part other than the grain fringe part, namely, the grain center part does not contain 5 or more dislocation lines. The grain center part means the region in the inner side surrounded by the fringe region when the grain is viewed from the direction perpendicular to the main plane.

In the tabular grain of the present invention, the fringe part region is preferably from 0.05 to 0.25 $\mu$m, more preferably from 0.10 to 0.20 $\mu$m. If the fringe part region is out of this range, the intrinsic sensitivity may not be successfully elevated.

In the present invention, for determining the ratio of grains containing a dislocation line and the number of dislocation lines, it is preferred to directly observe the dislocation lines of at least 100 grains, preferably 200 grains or more, more preferably 300 grains or more.

In the emulsion of the present invention, 50% or more of the entire projected area is preferably occupied by tabular grains in which the average silver iodide content in the grain fringe part is 2 mol % or more higher than the average silver iodide content in grain center part, more preferably by tabular grains in which the average silver iodide content in the grain fringe part is 4 mol % or more higher than the average silver iodide content in grain center part, still more preferably by tabular grains in which the average silver iodide content in the grain fringe part is 5 mol % or more higher than the average silver iodide content in grain center part.

The silver iodide content within a tabular grain can be determined by a method described, for example, in JP-A-7-219102 using an analytical electron microscope.

The tabular grain of the present invention preferably contains one or more photographically useful metal ion or complex (hereinafter referred to as "metal (complex) ion") within the grain.

The doping of metal ion into the inside of a silver halide grain is described below.

The photographically useful metal (complex) ion is doped into a grain for the purpose of improving the photographic properties of the light-sensitive silver halide emulsion. This compound acts as a transient or permanent trap for electrons or positive holes in the silver halide crystal and gives effects such as high sensitivity, high contrast and improvement of reciprocity law characteristics and pressure property.

In the present invention, the metal doped into the emulsion grain is preferably a first, second or third transition metal element such as iron, ruthenium, rhodium, palladium, cadmium, rhenium, osmium, iridium, platinum, chromium and vanadium, or an amphoteric metal element such as gallium, indium, thallium and lead. The metal ion is doped in the form of a complex salt or a single salt. In the case of complex ion, a six-coordinated halogeno complex or cyano complex using halogen ion or cyan (CN) ion as the ligand is preferably used.

In addition, a complex having nitrosyl (NO) ligand, thionitrosyl (NS) ligand, carbonyl (CO) ligand, thiocarbonyl (CS) ligand, thiocyanogen (NCS) ligand, selenocyanate (NCSe) ligand, tellulocyanate (CNTe) ligand, dinitrogen (N2) ligand, azide (N3) ligand or an organic ligand such as bipyridyl ligand, cyclopentadienyl ligand, 1,2-dithiolenyl ligand and imidazole ligand, may be used. For the ligand, the following multidentate ligands may also be used. That is, any of a bidentate ligand such as bipyridyl ligand, a tridentate ligand such as diethyl-triamine, a tetradentate ligand such as triethylene tetramine, and a hexadentate ligand such as ethylene-diaminetetraacetic acid may be used. The number of ligands is preferably 6 but may be 4. With respect to the organic ligand, those described in U.S. Pat. Nos. 5,457,021, 5,360,712 and 5,462,849 may be preferably used. As described in U.S. Pat. No. 5,024,9391, it is also preferred to integrate the metal ion in the form of an oligomer.

In integrating the metal (complex) ion into silver halide, the matter of importance is whether the size of the metal (complex) ion fits to the lattice spacing of the silver halide. In addition, for doping the metal (complex) ion into the silver halide, the compound of the metal (complex) ion with silver or halogen ion must co-precipitate together with silver halide. For this purpose, the compound of the metal (complex) ion with silver or halogen ion must have a pKsp (a common logarithm of the reciprocal of the solubility product) on the order equal to the pKsp of silver halide (silver chloride: 9.8, silver bromide: 12.3, silver iodide: 16.1). Accordingly, the compound of the metal (complex) ion with silver or halogen ion preferably has a pKsp of 8 to 20.

The amount of the metal complex doped into a silver halide grain is generally from $10^{-9}$ to $10^{-2}$ mol per mol of silver halide. More specifically, in the case of a metal complex which provides a transient shallow electron trap in the exposure process, the doped amount is preferably from $10^{-6}$ to $10^{-2}$ mol per mol of silver halide and in the case of a metal complex which provides a deep electron trap in the exposure process, the doped amount is preferably from $10^{-9}$ to $10^{-5}$ mol per mol of silver halide.

The metal (complex) ion content in the emulsion grain can be confirmed by atomic-absorption spectroscopy, polarization Zeeman spectroscopy, ICP analysis or the like. The ligand of the metal (complex) ion can be confirmed by IR-absorption (particularly FT-IR).

The metal (complex) ion may be doped into a silver halide grain by selecting the doping position according to the purpose and may be doped into the surface or internal phase of the grain or into the very shallow surface on the order of not exposing the metal ion out of the surface (so-called sub-surface) described in U.S. Pat. Nos. 5,132,203 and 4,997,751. A plurality of metal ions may also be doped and they may be doped into the same phase or different phases. These compounds may be added by mixing the metal salt solution with the aqueous halide solution or water-soluble silver salt solution added at the grain formation. The metal salt solution may also be directly added or silver halide emulsion fine grains where the metal ion is doped may be added. In the case of dissolving the metal salt in water or an appropriate solvent such as methanol or acetone, a method of adding an aqueous hydrogen halogenide (e.g., HCl, HBr) solution, a thiocyanic acid or a salt thereof, or an alkali halide (e.g., KCl, NaCl, KBr, NaBr) is preferably used so as to stabilize the solution. If desired, an acid, an alkali or the like is preferably added for the same purpose.

In the case where cyano complex metal ion is doped into the emulsion grain, cyan is generated upon reaction between gelatin and the cyano complex and the gold sensitization is inhibited in some cases. If the case is so, for example, a compound having a function of inhibiting the reaction between gelatin and the cyano complex is preferably used in combination as described, for example, in JP-A-6-308653. More specifically, the process after the doping of the cyano complex metal ion is preferably performed in the presence of metal ion capable of coordination bonding to gelatin, such as zinc ion.

It is known that when the tabular silver halide grains are formed by using the silver halide fine grains in the growing process of the grains, the extremely thin tabular grains having a uniform halide composition are obtained.

The silver bromide content of the silver halide fine grain is preferably 50 mol % or more, more preferably 70 mol % or more.

The average equivalent-sphere diameter of the silver halide fine grain is preferably 0.02 $\mu$m or less, more preferably 0.015 $\mu$m or less.

The coefficient of variation of the equivalent-sphere diameter is a value obtained by dividing the standard deviation of the equivalent-sphere diameter by the average value and multiplying the obtained value by 100. The coefficient of variation in the equivalent-sphere diameter of the silver halide fine grain is preferably 30% or less, more preferably 25% or less, and most preferably 20% or less.

The number ratio of grains containing a twin plane can be measured by forming silver halide fine grains, immediately thereafter adding an aqueous silver salt solution and an aqueous halide salt solution to those grains at an appropriate addition rate while taking care not to generate new nuclei or cause disappearance of the fine grains, and observing the shape of grown silver halide grains through an electron microscope. The number ratio of grains containing a twin plane is preferably 3% or less, more preferably 2% or less.

In the tabular silver halide grain emulsion formed using a silver halide fine grain emulsion in the growing process, the silver halide fine grains preferably remain as little as possible. The remaining fine grain has a very small equivalent-sphere diameter as compared with the grown tabular grain, therefore, these may be separated using a grain size distribution meter having a high size-resolving power, such as a grain size distribution meter using centrifugal separation. It is also possible to quantitatively determine the volume fraction of the remaining silver halide fine grains. The observation through an electron microscope causes a great difference depending on the field of view and moreover, since a pretreatment such as centrifugal separation is generally applied so as to remove excess gelatin in the emulsion, the remaining degree of tabular grains is difficult to quantitatively estimate. In the present invention, the volume fraction of the remaining fine grains is measured using a centrifugal grain size distribution meter manufactured by U.S. Chemical Process Specialists. The volume fraction of the remaining fine grains is preferably 4% or less, more preferably 2% or less, and most preferably 1% or less.

The emulsion of the present invention and other photographic emulsion used in combination therewith out of the scope of the present invention can be prepared according to the method described in P. Glafkides, *Chimie et Phisique Photographigue,* Paul Montel (1967), G. F. Duffin, *Photographic Emulsion Chemistry,* The Focal Press (1966), V. L. Zelikman et al, *Making and Coating Photographic Emulsion,* The Focal Press (1964), or the like. More specifically, any of acid process, neutral process and ammonia process may be used and the reaction between a soluble silver salt and a soluble halogen salt may be performed by a single jet method, a double jet method or a combination thereof. Also, a method of forming grains in an atmosphere of excess silver ion (so-called reverse mixing method) may be used. As one form of the double jet method, a so-called controlled double jet method where the pAg of the liquid phase in which silver halide is formed is kept constant may also be used. According to this method, the silver halide emulsion obtained can have a regular crystal form and a nearly uniform grain size.

Depending on the case, a method of adding silver halide grains previously precipitated and formed in a reaction vessel for the preparation of an emulsion or a method described in U.S. Pat. Nos. 4,334,012, 4,301,241 and 4,150,994 is preferred. The thus-formed grain may be used as a seed crystal or may be effectively supplied as a silver halide for the growth. In the latter case, an emulsion having a small grain size is preferably added and the emulsion may be added wholly at once, may be added in parts a plurality of times or may be continuously added. Furthermore, depending on the case, it is also effective for modifying the surface to add grains having various halogen compositions.

A method of converting a majority or a very small part of the halogen composition of a silver halide grain by the halogen conversion is disclosed in U.S. Pat. Nos. 3,477,852 and 4,142,900, EP-A-273429, EP-A-273430 and German Patent Application (OLS) No. 3,819,241 and this is an effective grain formation method. In order to attain conversion into a more sparingly soluble silver salt, a soluble halogen solution or a silver halide grain may be added. The halogen composition may be converted all at once, may be converted in parts a plurality of times or may be continuously converted.

For growing grains, in addition to the method of adding a soluble silver salt and a halogen salt in a constant concentration at a fixed flow rate, a method of forming grains by varying the concentration or varying the flow rate described in British Patent 1,469,480 and U.S. Pat. Nos. 3,650,757 and 4,242,445 may be preferably used. By increasing the concentration or increasing the flow rate, the amount of silver halide fed can be varied according to the linear, secondary or more complicated function of the addition time. Depending on the case, the amount of silver halide fed is preferably reduced, if desired. Furthermore, in the case where a plurality of soluble silver salts different in the solution composition are added or a plurality of soluble halogen salts different in the solution composition are added, it is also effective to add the salts by increasing one and decreasing the other.

The mixer used for the reaction between the soluble silver salt solution and the soluble halogen salt solution may be selected from those used in the methods described in U.S. Pat. Nos. 2,996,287, 3,342,605, 3,415,650 and 3,785,777 and West German Patent Application (OLS) Nos. 2,556,885 and 2,555,364.

For accelerating the ripening, a silver halide solvent is effective. For example, a method of allowing an excess amount of halogen ion to be present in the reactor and thereby accelerating the ripening is known. Other ripening agents may also be used. The ripening agent may be wholly blended with the dispersion medium in the reactor before adding silver and halide salts or may be introduced into the reactor together with the addition of halide salt, silver salt or deflocculant. In another modified embodiment, a ripening agent may be independently introduced at the stage of adding halide salt and silver salt.

Examples of the ripening agent include ammonia, thiocyanates (e.g., potassium thiocyanate, ammonium thiocyanate), organic thioether compounds (e.g., compounds described in U.S. Pat. Nos. 3,574,628, 3,021,215, 3,057,724, 3,038,805, 4,276,374, 4,297,439, 3,704,130 and 4,782,013, JP-A-57-104926), thione compounds (e.g., quaternary substituted thiourea described in JP-A-53-82408, JP-A-55-77737, U.S. Pat. No. 4,221,863, compounds described in JP-A-53-144319), mercapto compounds capable of accelerating the growth of silver halide grains described in JP-A-57-202531 and amine compounds (e.g., those described in JP-A-54-100717).

For the protective colloid used in the preparation of the emulsion of the present invention and for the binder in other hydrophilic colloidal layers, gelatin is advantageously used, however, other hydrophilic colloids may also be used.

Examples thereof include proteins such as gelatin derivatives, graft polymers of gelatin to other polymer, albumin and casein; saccharide derivatives such as cellulose derivatives (e.g., hydroxyethyl cellulose, carboxymethyl cellulose, cellulose sulfate), sodium arginates and starch derivatives; and various synthetic hydrophilic polymer materials including homopolymers and copolymers, such as polyvinyl alcohol, polyvinyl alcohol partial acetal, poly-N-vinylpyrrolidone, polyacrylic acid, polymethacrylic acid, polyacrylamide, polyvinyl imidazole and polyvinyl pyrazole.

The gelatin may be a lime-treated gelatin, an acid-treated gelatin or an enzyme-treated gelatin described in *Bull. Soc. Photo. Japan,* No. 16, p. 30 (1966). A hydrolyzate or enzymolyzate (i.e., enzyme-decomposition product) of gelatin may also be used.

The emulsion of the present invention is preferably washed with water for the purpose of desalting and dispersed in a newly prepared protective colloid. The temperature at the water washing may be selected according to the purpose but it is preferably selected within the range from 5 to 50° C. The pH at the water washing may also be selected according to the purpose but it is preferably selected within the range from 2 to 10, more preferably from 3 to 8. Furthermore, the pAg at the water washing may also be selected depending on the purpose but it is preferably selected between 5 and 10. The water washing method may be selected from a noodle washing method, a dialysis method using a semipermeable membrane, a centrifugal separation method, a coagulation precipitation method and an ion exchange method. In the case of the coagulation precipitation method, a method of using a sulfate, a method of using an organic solvent, a method of using a water-soluble polymer or a method of using a gelatin derivative may be selected.

The method of adding a chalcogen compound during the preparation of the emulsion described in U.S. Pat. No. 3,772,031 is also useful in some cases. Other than S, Se and Te, a cyanate, a thiocyanate, a selenocyanate, a carbonate, a phosphate or an acetate may also be present.

The silver halide grain of the present invention may be subjected to at least one of sulfur sensitization, selenium sensitization, gold sensitization, palladium sensitization, noble metal sensitization and reduction sensitization, at any step in the process of preparing the silver halide emulsion. A combination of two or more sensitization methods is preferably used. By varying the step of performing the chemical sensitization, various types of emulsions may be prepared. Examples thereof include a type where chemical sensitization specks are embedded inside the grain, a type where chemical sensitization specks are embedded in the shallow part from the grain surface, and a type where chemical sensitization specks are formed on the grain surface. In the emulsion of the present invention, the site of chemical sensitization speck can be selected according to the purpose, however, in general, at least one kind of chemical sensitization speck is preferably formed in the vicinity of the surface.

The chemical sensitization which can be preferably performed in the present invention is chalcogen sensitization, noble metal sensitization or a combination thereof. As described in T. H. James, *The Theory of the Photographic Process,* 4th ed. Macmillan, pp. 67–76 (1977), the chemical sensitization may be performed using active gelatin. Furthermore, as described in *Research Disclosure,* Vol. 120, 12008 (April, 1974), *Research Disclosure,* Vol. 34, 13452 (June, 1975), U.S. Pat. Nos. 2,642,361, 3,297,446, 3,772,031, 3,857,711, 3,901,714, 4,266,018 and 3,904,415 and British Patent 1,315,755, the chemical sensitization may be performed using sulfur, selenium, tellurium, gold, platinum, palladium, iridium or a combination of two or more of these sensitizing dyes at a pAg of 5 to 10, a pH of 5 to 8 and a temperature of 30 to 80° C. In the noble metal sensitization, a noble metal salt such as gold, platinum, palladium or iridium may be used and in particular, gold sensitization, palladium sensitization and a combination thereof are preferred. In the case of gold sensitization, a well-known compound such as chloroauric acid, potassium chloroaurate, potassium aurithiocyanate, gold sulfide or gold selenide may be used. The palladium compound means a palladium divalent salt or tetravalent salt. The preferred palladium compound is represented by $R_2PdX_6$ or $R_2PdX_4$, wherein R represents a hydrogen atom, an alkali metal atom or an ammonium group and X represents a halogen atom such as chlorine, bromine or iodine.

More specifically, $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$ are preferred. The gold compound and the palladium compound each is preferably used in combination of a thiocyanate or a selenocyanate.

As the sulfur sensitizer, hypo, a thiourea-based compound, a rhodanine-based compound or a sulfur-containing compound described in U.S. Pat. Nos. 3,857,711, 4,266,018 and 4,054,457 may be used. The chemical sensitization may also be performed in the presence of a so-called chemical sensitization aid. Useful chemical sensitization aids include the compounds known to suppress the fogging and at the same time elevate the sensitivity in the process of chemical sensitization, such as azaindene, azapyridazine and azapyrimidine. Examples of the chemical sensitization aid modifier are described in U.S. Pat. Nos. 2,131,038, 3,411,914 and 3,554,757, JP-A-58-126526 and Duffin, *Photographic Emulsion Chemistry,* pp. 138–143.

In the case of the emulsion of the present invention, gold sensitization is preferably performed in combination. The amount of the gold sensitizer is preferably from $1\times10^{-7}$ to $1\times10^{-4}$ mol, more preferably from $5\times10^{-7}$ to $1\times10^{-5}$ mol, per mol of silver halide. The amount of the palladium compound is preferably from $5\times10^{-7}$ to $1\times10^{-3}$ mol per mol of silver halide. The amount of the thiocyanate compound or the selenocyanate compound is preferably from $1\times10^{-6}$ to $5\times10^{-2}$ mol per mol of silver halide.

The amount of the sulfur sensitizer used for the silver halide grain of the present invention is preferably from $1\times10^{-7}$ to $1\times10^{-4}$, more preferably from $5\times10^{-7}$ to $1\times10^{-5}$ mol, per mol of silver halide.

The preferred sensitization method for the emulsion of the present invention includes selenium sensitization. In the selenium sensitization, a well-known labile selenium compound is used and specific examples of the selenium compound which can be used include colloidal metal selenium, selenoureas (e.g., N,N-dimethylselenourea, N,N-diethylselenourea), selenoketones and selenoamides. In some cases, the selenium sensitization is preferably performed in combination with one or both of sulfur sensitization and noble metal sensitization.

The silver halide emulsion of the present invention is preferably subjected to reduction sensitization during the grain formation, before or during the chemical sensitization after the grain formation, or after the chemical sensitization.

For the reduction sensitization, a method of adding a reduction sensitizer to the silver halide emulsion, a method called silver ripening where the emulsion is grown or ripened in a high pH atmosphere at a pAg of 1 to 7, and a method called high pH ripening where the emulsion is grown or ripened in a high pH atmosphere at a pH of 8 to 11 may be used. Also, two or more of these methods may be used in combination.

The method of adding a reduction sensitizer is preferred because the reduction sensitization level can be subtly controlled.

The photographic additives which can be used are described in RD and the pertinent portions are shown in the Table below.

| Kinds of Additives | RD17643 | RD18716 | RD307105 |
|---|---|---|---|
| 1. Chemical sensitizer | p. 23 | p. 648, right col. | p. 866 |
| 2. Sensitivity increasing agent | | p. 648, right col. | |
| 3. Spectral sensitizer, supersensitizer | pp. 23–24 | p. 648, right col. to p. 649, right col. | pp. 866–868 |
| 4. Brightening agent | p. 24 | p. 647, right col. | p. 868 |
| 5. Light absorbent, filter dye, UV absorbent | pp. 25–26 | p. 649, right col. to p. 650, left col. | p. 873 |
| 6. Binder | p. 26 | p. 651, left col. | pp. 873–874 |
| 7. Plasticizer, lubricant | p. 27 | p. 650, right col. | p. 876 |
| 8. Coating aid, surface active agent | pp. 26–27 | p. 650, right col. | pp. 875–876 |
| 9. Antistatic agent | p. 27 | p. 650, right col. | pp. 876–877 |
| 10. Matting agent | | | pp. 878–879 |

The present invention is described below in greater detail by referring to Examples, but the present invention should not be construed as being limited to these examples.

EXAMPLE 1

Gelatin 1 to Gelatin 3 used as a dispersion medium in the preparation of emulsions below had the following properties.

Gelatin 1

Ordinary alkali-treated ossein gelatin using bovine bone as the raw material. The molecular weight distribution had a plurality of peaks and was polydisperse.

Gelatin 2

This gelatin was obtained by letting an enzyme act on Gelatin 1 to lower the molecular weight to an average molecular weight of 15,000, deactivating the enzyme and drying the gelatin. The molecular weight distribution had substantially a single peak but the distribution width was ±300% of the average value.

Gelatin 3

RAT COL3A1 produced using the genetic engineering technique described in EP-A-0926543. The molecular weight distribution had substantially a single peak and the distribution width was ±80% of the average value.

(Preparation of Emulsions)

Emulsion 1-A (Preparation of Seed Crystal)

To 1,600 ml of an aqueous solution containing 8.3 g of Gelatin 1 and 4.3 g of KBr, which was kept at 40° C. with stirring, 41 ml of an aqueous 1.2M $AgNO_3$ solution and 41 ml of an aqueous 1.26M KBr solution containing 4.3 mol % of KI were simultaneously added by a double jet method over 40 seconds. Thereafter, 36 g of gelatin (lime-treated gelatin) was added, the temperature was elevated to 58° C. over 20 minutes, the pAg was adjusted to 8.44, and ammonia was added. The emulsion was ripened for 15 minutes and then neutralized. Subsequently, 647 ml of an aqueous 1.9M $AgNO_3$ solution and an aqueous 1.9M KBr solution were simultaneously added over 55 minutes at an accelerated flow rate (the flow rate at the finish was 5 times the flow rate at the starting) while keeping the pAg at 8.10. The resulting emulsion was cooled to 35° C. and washed with water by an ordinary flocculation method and thereto, 49 g of lime-treated gelatin was added and dispersed. The emulsion obtained was adjusted to a pH of 6.2 and a pAg of 8.9 and then stocked.

(Growth of Grains)

To 48 g of the seed crystal prepared above containing silver iodobromide corresponding to 9.3 g in terms of the amount of $AgNO_3$, 1,145 ml of water and 36 g of gelatin (lime-treated gelatin) were added. The resulting solution was stirred while keeping the temperature at 75° C. and then adjusted to a pH of 5.5 and a pAg of 8.44. Thereto, 479 ml of an aqueous 1.9M $AgNO_3$ solution and an aqueous 1.7M KBr solution containing 2.7 mol % of KI were simultaneously added over 48 minutes at an accelerated flow rate (the flow rate at the finish was 2.4 times the flow rate at the starting) while keeping the pAg at 8.29. Furthermore, 50 ml of an aqueous 1.9M $AgNO_3$ solution and an aqueous 1.9M KBr solution were simultaneously added over 5 minutes at a constant flow rate while keeping the pAg at 8.44. Thereafter, the temperature was lowered to 40° C. over 25 minutes, an aqueous solution containing 10.5 g of sodium P-iodoacetamidobenzenesulfonate (monohydrate) as an iodide ion-releasing agent was added, and 40 ml of an aqueous 0.8M sodium sulfite solution was added at a constants flow rate over 1 minute. While adjusting the pH to 9.0, iodide ion was produced and after 2 minutes, the temperature was elevated to 55° C. over 15 minutes. Thereafter, the pH was returned to 5.5 and then sodium benzenethiosulfonate and $K_2IrCl_6$ each in the form of a solution were added in an amount of $3.8\times10^{-6}$ mol/mol-Ag and $1\times10^{-8}$ mol/mol-Ag, respectively, based on the total silver amount. Furthermore, 269 ml of an aqueous 1.9M $AgNO_3$ solution and an aqueous 1.9M KBr solution containing no dopant were simultaneously added at a constant flow rate over 30 minutes while keeping the pAg at 8.59. Thus, Emulsion 1-A having the grain shape shown in Table 1 was prepared (the grain shape of the emulsion was determined by the method described in the specification; the same applies to the following emulsions).

TABLE 1

| Sample Name | Emulsion Name | Grains Occupying 50% or more of Entire Projected Area | Kind of Gelatin Used for Nucleation | Viscosity at Nucleation (relationship with η of formula (1)) |
|---|---|---|---|---|
| 101 | 1-A | Aspect ratio of 4 or more and twin, plane spacing of 0.013 μm or more | Gelatin 1 | X (>η) |
| 102 | 1-B | Aspect ratio of 4 or more and twin, plane spacing of 0.013 μm or more | Gelatin 2 | X |
| 103 | 1-C | Aspect ratio of 4 or more and twin, plane spacing of 0.013 μm or more | Gelatin 3 | ○(>η) |
| 104 | 1-D | Aspect ratio of 4 or more and twin, plane spacing of 0.013 μm or more | " | ○ |
| 105 | 1-E | Aspect ratio of 4 or more and twin, plane spacing of 0.012 μm or less | Gelatin 1 | X |
| 106 | 1-F | Aspect ratio of 4 or more and twin, plane spacing of 0.012 μm or less | Gelatin 2 | X |
| 107 | 1-G | Aspect ratio of 4 or more and twin, plane spacing of 0.012 μm or less | Gelatin 3 | ○ |
| 108 | 1-H | Aspect ratio of 4 or more and twin, plane spacing of 0.012 μm or less | " | ○ |
| 109 | 1-I | Aspect ratio of 4 or more and twin, plane spacing of 0.010 μm or less | Gelatin 1 | X |
| 110 | 1-J | Aspect ratio of 4 or more and twin, plane spacing of 0.010 μm or less | Gelatin 2 | X |
| 111 | 1-K | Aspect ratio of 4 or more and twin, plane spacing of 0.010 μm or less | Gelatin 3 | ○ |
| 112 | 1-L | Aspect ratio of 4 or more and twin, plane spacing of 0.010 μm or less | " | ○ |
| 201 | 1-M | aspect ratio of 8 or more and twin, plane spacing of 0.013 μm or more | Gelatin 1 | X |
| 202 | 1-N | aspect ratio of 8 or more and twin, plane spacing of 0.013 μm or more | Gelatin 2 | X |
| 203 | 1-O | aspect ratio of 8 or more and twin, plane spacing of 0.013 μm or more | Gelatin 3 | ○ |
| 204 | 1-P | aspect ratio of 8 or more and twin, plane spacing of 0.013 μm or more | " | ○ |
| 205 | 1-Q | aspect ratio of 8 or more and twin, plane spacing of 0.012 μm or less | Gelatin 1 | X |
| 206 | 1-R | aspect ratio of 8 or more and twin, plane spacing of 0.012 μm or less | Gelatin 2 | X |

TABLE 1-continued

| | | | | |
|---|---|---|---|---|
| 207 | 1-S | aspect ratio of 8 or more and twin, plane spacing of 0.012 μm or less | Gelatin 3 | ○ |
| 208 | 1-T | aspect ratio of 8 or more and twin, plane spacing of 0.012 μm or less | " | ○ |
| 209 | 1-U | aspect ratio of 8 or more and twin, plane spacing of 0.010 μm or less | Gelatin 1 | X |
| 210 | 1-V | aspect ratio of 8 or more and twin, plane spacing of 0.010 μm or less | Gelatin 2 | X |
| 211 | 1-W | aspect ratio of 8 or more and twin, plane spacing of 0.010 μm or less | Gelatin 3 | ○ |
| 212 | 1-Y | aspect ratio of 8 or more and twin, plane spacing of 0.010 μm or less | " | ○ |

| Sample Name | Coefficient of Variation in Twin Plane Spacing Distribution (%) | Ratio of Tabular Grains Occupying in Entire Projected Area (%) | Coefficient of Variation in Equivalent-circle Diameter Distribution (%) | Fog | Sensi-tivity | Remarks |
|---|---|---|---|---|---|---|
| 101 | 29 | 92 | 31 | 100 | 100 | Comparison |
| 102 | 27 | 94 | 26 | 98 | 103 | " |
| 103 | 23 | 96 | 20 | 85 | 110 | " |
| 104 | 14 | 97 | 18 | 83 | 115 | " |
| 105 | 28 | 93 | 30 | 105 | 105 | Comparison |
| 106 | 26 | 95 | 25 | 103 | 108 | " |
| 107 | 22 | 98 | 18 | 55 | 160 | Invention |
| 108 | 14 | 99 | 15 | 45 | 170 | " |
| 109 | 27 | 94 | 30 | 110 | 106 | Comparison |
| 110 | 27 | 95 | 24 | 113 | 107 | " |
| 111 | 22 | 99 | 15 | 50 | 165 | Invention |
| 112 | 14 | 99 | 12 | 45 | 180 | " |
| 201 | 27 | 90 | 32 | 100 | 100 | Comparison |
| 202 | 26 | 92 | 27 | 97 | 103 | " |
| 203 | 23 | 95 | 20 | 86 | 111 | " |
| 204 | 14 | 96 | 17 | 84 | 116 | " |
| 205 | 26 | 91 | 31 | 104 | 106 | Comparison |
| 206 | 26 | 93 | 25 | 104 | 109 | " |
| 207 | 22 | 96 | 18 | 54 | 165 | Invention |
| 208 | 14 | 97 | 14 | 46 | 172 | " |
| 209 | 26 | 91 | 30 | 111 | 105 | Comparison |
| 210 | 27 | 93 | 25 | 114 | 108 | " |
| 211 | 22 | 96 | 16 | 49 | 168 | Invention |
| 212 | 14 | 96 | 13 | 44 | 170 | " |

Emulsions 1-B to 1-Y

Emulsions 1-B to 1-Y shown in Table 1 (the grain size was agreed to Emulsion 1-A) were prepared by changing the temperature and pAg at the nucleation, the amount of silver used for the nucleation, the kind and the added amount of gelatin and the ripening time in the grain formation of Emulsion 1-A, and also controlling the pAg at the grain formation. These emulsions were chemically sensitized in the same manner as Emulsion 1-A using a red-sensitive emulsion according to the method described in Example 1 of Japanese Patent Application No. 11-80618.

However, in the case of Emulsions 1-D, 1-H, 1-L, 1-P, 1-T and 1-Y, the nucleation temperature was kept at 20° C. (in others, 40° C.).

The viscosity of the aqueous gelatin solution in the reaction vessel at each nucleation time of Emulsions 1-A to 1-Y was measured and the results obtained are shown in Table 1 (the relationship with η of formula (1) in the specification).

(Preparation of Coated Samples)

Samples 101 to 112 and 201 to 212 were prepared by using Emulsions 1-A to 1-Y obtained above in place of the high-speed red-sensitive emulsion in Sample 101 for the multi-layer color photographic light-sensitive material described in the Example of Japanese Patent Application No. 11-57097.

(Development Processing and Evaluation)

Samples 101 to 112 and 201 to 212 were subjected to the color negative processing described in Examples of Japanese Patent Application No. 11-57097. The processed samples were measured on the density through a red filter and evaluated on the photographic performance. The sensitivity was evaluated by the relative value of reciprocal of the exposure amount necessary for the cyan density to reach (fog density+0.15). Relative values to Sample 101 or 201 as 100 are shown. The fog is also shown by a relative value to Sample 101 or 201 as 100 (the smaller the value, the lower the fog).

The results obtained are shown in Table 1.

It is seen from the results that by the emulsion of the present invention, remarkable reduction of fogging and high elevation of sensitivity can be attained.

EXAMPLE 2

In this Example, silver halide grains were formed.

Gelatin 1

Ordinary alkali-treated ossein gelatin using bovine bone as the raw material. The molecular weight distribution had a plurality of peaks and was polydisperse.

Gelatin 2:

This gelatin was obtained by letting an enzyme act on Gelatin 1 to lower the molecular weight to an average molecular weight of 15,000, deactivating the enzyme and drying the gelatin. The molecular weight distribution had substantially a single peak but the distribution width was ±300% of the average value.

Gelatin 3:

RAT COL3A1 produced using the genetic engineering technique described in EP-A-0926543. The molecular weight distribution had substantially a single peak and the distribution width was ±80% of the average value.

Using a stirring apparatus described in JP-10-43570, silver halide fine grains were formed. The stirring tank had a volume of 15 ml and a stirring blade was rotated at 5,000 rpm.

From one feeding port of the stirring tank, 1.5 mol/l of a silver nitrate solution kept at 20° C. was added at a rate of 452 ml/min, and from another feeding port, an aqueous solution kept at 20° C. and containing 1.455 mol/l of silver bromide, 0.045 mol/l of silver iodide and 14% of Gelatin 1 was added at a rate of 455 ml/min. Silver Halide Fine Grain Emulsion 2-A discharged had an equivalent sphere diameter and the like shown in Table 2.

Silver Halide Fine Grain Emulsions 2-B and 2-C were formed in the same manner as above except for using Gelatin 2 or Gelatin 3 in place of Gelatin 1. The results are shown in Table 2.

Experiments were performed in the same manner by keeping the temperature of aqueous solutions added at 10° C. In the case where Gelatin 1 was used, a part of the solution added was gelled and the solution could not be added. Silver Halide Fine Grain Emulsions 2-D and 2-E obtained by using Gelatin 2 and Gelatin 3, respectively, had an equivalent-sphere diameter and the like shown in Table 3.

TABLE 2

| Emulsion | Gelatin | Viscosity Condition of Formula (1) | Average Equivalent-Sphere Diameter [μm] | Coefficient of Variation [%] | Twin Ratio [%] |
|---|---|---|---|---|---|
| 2-A | Gelatin 1 | Not satisfied | 0.035 | 35 | 6 |
| 2-B | Gelatin 2 | Not satisfied | 0.025 | 32 | 2 |
| 2-C | Gelatin 3 | Satisfied | 0.020 | 25 | 2 |

TABLE 3

| Emulsion | Gelatin | Viscosity Condition of Formula (1) | Average Equivalent-Sphere Diameter [μm] | Coefficient of Variation [%] | Twin Ratio [%] |
|---|---|---|---|---|---|
| — | Gelatin 1 | Not satisfied | — | — | — |
| 2-D | Gelatin 2 | Not satisfied | 0.021 | 27 | 5 |
| 2-E | Gelatin 3 | Satisfied | 0.014 | 19 | 3 |

(In the case where Gelatin 1 was used, a part of the solution added was set and the solution could not be added.)

It is seen from the results shown above that when the gelatin of the present invention is used, the silver halide grains obtained can have a small average equivalent-sphere diameter, a small coefficient of variation of the equivalent-sphere diameter and a small twin ratio.

In the following, tabular silver halide grains were prepared using silver halide fine grains.

1,300 ml of an aqueous solution containing 1.0 g of KBr and 1.1 g of Gelatin 2 was kept at 35° C. and stirred (1st preparation of solution). Thereto, 38 ml of Aqueous Solution Ag-1 (containing 4.9 g of $AgNO_3$ in 100 ml), 29 ml of Aqueous Solution X-1 (containing 5.2 g of KBr in 100 ml) and 8.5 ml of Aqueous Solution G-1 (containing 8.0 g of Gelatin 2 in 100 ml) were added by a triple jet method at a constant flow rate over 30 seconds (Addition 1) Thereafter, 6.5 g of KBr was added and the temperature was elevated to 75° C. After the elevation of the temperature, the emulsion was ripened for 12 minutes and thereto, 300 ml of Aqueous Solution G-2 (containing 12.7 g of Gelatin 1 in 100 ml) was added. Subsequently, 2.1 g of disodium 4,5-dihydroxy-1,3-disulfonate monohydrate and 0.002 g of thiourea dioxide were added in sequence at intervals of 1 minute.

Thereafter, 157 ml of Aqueous Solution Ag-2 (containing 22.1 g of $AgNO_3$ in 100 ml) and Aqueous solution X-2 (containing 15.5 g of KBr in 100 ml) were added by the double jet method over 28 minutes. At this time, Aqueous Solution Ag-2 was added by accelerating the flow rate such that the final flow rate became 3.4 times the initial flow rate, and Aqueous Solution X-2 was added so as to keep the pAg of the bulk emulsion solution in the reaction vessel at 7.83 (Addition 2). Subsequently, 826 ml of Silver Halide Fine Grain Emulsion 2-A was added at a constant flow rate over 66 minutes by a double jet method. At this time, Aqueous Solution X-2 was also simultaneously added so as to keep the pAg of the bulk emulsion solution at 7.83 (Addition 3). Furthermore, 156 ml of Aqueous Solution Ag-4 (containing 32.0 g of $AgNO_3$ in 100 ml) and Aqueous Solution X-4 (containing 22.4 g of KBr 100 ml) were added over 17 minutes by the double jet method. At this time, Aqueous Solution Ag-4 was added at a constant flow rate and Aqueous Solution X-4 was added so as to keep the pAg of the bulk emulsion solution in the reaction vessel at 7.52 (Addition 4).

Thereafter, 0.0025 g of sodium benzenethiosulfonate and 125 ml of Aqueous Solution G-3 (containing 12.0 g of Gelatin 1 in 100 ml) were added sequentially at intervals of 1 minute. Subsequently, 43.7 g of KBr was added to adjust the pAg of the bulk emulsion solution in the reaction vessel to 9.00 and then 73.9 g of an AgI fine grain emulsion (containing 13.0 g of AgI fine grains having an average grain size of 0.047 μm in 100 g) was added. After 2 minutes, 249 ml of Aqueous Solution Ag-4 and Aqueous Solution X-4 were added by the double jet method. At this time, Aqueous Solution Ag-4 was added at a constant flow rate over 9 minutes and Aqueous Solution X-4 was added only for the first 3.3 minutes so as to keep the pAg of the bulk emulsion solution in the reaction vessel at 9.00 and not added for the remaining 5.7 minutes to finally adjust the pAg of the bulk emulsion solution in the reaction vessel to 8.4 (Addition 5). Thereafter, the emulsion was desalted by an ordinary flocculation method and then water, NaOH and Gelatin 1 were added while stirring to adjust the pH and the pAg at 56° C. to 6.4 and 8.6, respectively.

The thus-obtained emulsion contained silver halide regular crystal grains having an equivalent-sphere diameter of about 0.06 μm and silver halide tabular grains having parallel main planes of (111) face. The silver halide tabular grains had an average equivalent-sphere diameter of 0.96 μm and an average aspect ratio of 18.5. In the emulsion, 50% or more of the entire projected area was occupied by tabular grains having an aspect ratio of 4 or more and a twin plane spacing of 0.012 μm or less. The volume fraction of regular crystal grains to all grains was 9%. This emulsion was designated as Silver Halide Emulsion 3-A.

Emulsions 3-B to 3-E were prepared by using Emulsions 2-B to 2-E, respectively, in place of Emulsion 2-A in the above-described preparation method of silver halide grains. Emulsions 3-B to 3-E all contained tabular grains having an aspect ratio of 18 to 20 and remaining regular crystal fine grains. The volume fraction of regular crystal fine grains in each emulsion is shown in Table 4.

TABLE 4

| Emulsion | Volume Fraction of Regular Crystal Grains (%) |
|---|---|
| 3-A | 9 |
| 3-B | 7 |
| 3-C | 1.5 |
| 3-D | 5 |
| 3-E | 1 or less |

It is seen from the results shown in Table 4 that when tabular grains are grown using silver halide fine grains of the present invention, a silver halide tabular grain emulsion reduced in the remaining fine grains can be obtained.

EXAMPLE 3

In the same manner as in Example 6 of JP-A-6-273869, gold/sulfur sensitization and spectral sensitization were optimally performed for preparing Emulsions 3-A to 3-E. Samples 301 to 305 were prepared by coating the obtained emulsions, respectively. The samples obtained had a shown in Table 5.

TABLE 5

| Sample | Sensitivity |
|---|---|
| 301 | 100 |
| 302 | 102 |
| 303 | 116 |
| 304 | 104 |
| 305 | 120 |

It is seen from the results of Table 5 that when tabular grains are grown using silver halide fine grains of the present invention, a silver halide tabular grain emulsion having high photographic sensitivity can be obtained.

EXAMPLE 4

Samples 401 to 405 were prepared by using Emulsions 3-A to 3-E, respectively, in place of Emulsion I in Sample 101 described in Example 1 of Japanese Patent Application No. 11-57097. For each emulsion, gold/sulfur sensitization and spectral sensitization were optimally performed. The photographic sensitivity of each sample is shown in Table 6.

TABLE 6

| Sample | Sensitivity |
|---|---|
| 401 | 100 |
| 402 | 101 |
| 403 | 107 |
| 404 | 103 |
| 405 | 112 |

It is seen from the results of Table 6 that when tabular grains are grown using silver halide fine grains of the present invention, a silver halide tabular grain emulsion having high photographic sensitivity can be obtained.

While the invention has been described in detail and with reference to specific embodiments thereof, it will be apparent to one skilled in the art that various changes and modifications can be made therein without departing from the spirit and scope thereof.

What is claimed is:

1. A process for producing a silver halide emulsion comprising silver halide grains, which is obtained through a process including at least one step of forming grains using a dispersion medium having a low viscosity, wherein the dispersion medium having a low viscosity comprises a polypeptide as a protective colloid, 50% or more of the entire projected area of all silver halide grains in the emulsion is occupied by silver halide tabular rains having an aspect ratio of 4 or more and a twin plane spacing of 0.012 $\mu$m or less, and the low viscosity is a region lower than the viscosity $\eta$ of the dispersion medium obtained by the following formula (1):

$$\eta=(2.8159-0.0743T)\exp\{(0.1479-0.0017T)C\} \quad (1)$$

wherein $\eta$ is a viscosity (cp) of the dispersion medium, T is the temperature (° C.) of the dispersion medium and C is the concentration (wt %) of the polypeptide in the dispersion medium.

2. The process for producing a silver halide emulsion as claimed in claim 1, wherein the polypeptide in the dispersion medium has a monodisperse molecular weight distribution.

3. The process for producing a silver halide emulsion as claimed in claim 1, wherein the polypeptide in the dispersion medium is produced using a technique of chemical synthesis or genetic engineering.

4. The process for producing a silver halide emulsion as claimed in claim 2, wherein the distribution width of the molecular weight is ±150% or less, with respect to the average molecular weight as the center.

5. The process for producing a silver halide emulsion as claimed in claim 1, which is prepared using a silver halide fine grain emulsion satisfying all the following requirements (i) to (iv):

(i) the silver bromide content is 50 mol % or more;

(ii) the average equivalent-sphere diameter is 0.02 $\mu$m or less;

(iii) the coefficient of variation of the equivalent-sphere diameter is 30% or less; and (iv) the ratio by number of grains containing a twin plane is 3% or less.

6. The process for producing a silver halide emulsion as claimed in claim 1, wherein the dispersion medium having a low viscosity is used at a nucleation step.

7. The process for producing a silver halide emulsion as claimed in claim 1, wherein the dispersion medium having a low viscosity is used at the temperature of 30° C. or less.

8. The process for producing a silver halide emulsion as claimed in claim 1, wherein the polypeptide is a gelatin.

* * * * *